US007511212B1

(12) United States Patent
Chang

(10) Patent No.: US 7,511,212 B1
(45) Date of Patent: Mar. 31, 2009

(54) MUSICAL INSTRUMENT STAND ASSEMBLY WITH FOLDABLE PEDAL

(75) Inventor: Ming Yi Chang, Taichung (TW)

(73) Assignee: Remarkable Company, Taichung (TW)

( * ) Notice: Subject to any disclaimer, the term of this patent is extended or adjusted under 35 U.S.C. 154(b) by 0 days.

(21) Appl. No.: 11/976,304

(22) Filed: Oct. 23, 2007

(51) Int. Cl.
*G10D 13/02* (2006.01)

(52) U.S. Cl. ..... 84/422.3; 84/422.1; 84/422.2

(58) Field of Classification Search ..... 84/422.1, 84/422.2, 422.3
See application file for complete search history.

(56) References Cited

U.S. PATENT DOCUMENTS 3,299,765 A * 1/1967 Rochon ..... 84/422.3
3,464,305 A * 9/1969 Meazzi et al. ..... 84/422.3
4,381,690 A * 5/1983 Kimble ..... 84/422.3
4,846,040 A * 7/1989 Hoshino ..... 84/422.1
5,251,528 A * 10/1993 Kurosaki ..... 84/422.3
6,075,192 A * 6/2000 Hoshino ..... 84/422.3
6,188,007 B1 * 2/2001 Liao ..... 84/422.3
6,229,080 B1 * 5/2001 Ishimatsu ..... 84/422.3
6,399,865 B1 * 6/2002 Ishimatsu ..... 84/421
6,437,225 B1 * 8/2002 Shigenaga ..... 84/422.3
6,822,150 B1 * 11/2004 Lombardi ..... 84/422.3
6,982,374 B2 * 1/2006 Hsieh ..... 84/422.1
7,288,708 B1 * 10/2007 Kassabian ..... 84/422.1
7,371,952 B1 * 5/2008 Tanaka ..... 84/422.1
7,375,272 B2 * 5/2008 Wang ..... 84/426

* cited by examiner

*Primary Examiner*—Walter Benson
*Assistant Examiner*—Robert W Horn
(74) *Attorney, Agent, or Firm*—Troxell Law Office PLLC

(57) ABSTRACT

A musical instrument stand assembly with a foldable pedal includes a main stand body, and the main stand body includes a main rod, and the bottom of the main rod includes two support rods each with a recession, and the recession includes a first circular serration; two side frames, and a sidewall of each side frame includes a protrusion and a second circular serration at the protrusion, and each side frame is installed by engaging each protrusion with the recession of each support rod, such that the first and second circular serrations are engaged with each other. With the design of rotably engaging the two side frames and the two support rods, the main stand body of the musical instrument has the function of adjusting its inclination with respect to a vertical position, and the effect of conveniently folding the pedal of the musical instrument.

7 Claims, 9 Drawing Sheets

MUSICAL INSTRUMENT STAND ASSEMBLY WITH FOLDABLE PEDAL

BACKGROUND OF THE INVENTION

1. Field of the Invention

The present invention relates to a musical instrument stand assembly with a foldable pedal, and more particularly to a stand assembly capable of adjusting the inclination of a main stand body of a musical instrument to facilitate the task of folding a pedal.

2. Description of the Related Art

In FIGS. 7 to 9, FIG. 7 shows a perspective view of a conventional musical instrument pedal folding assembly, FIG. 8 shows a side view of the assembly, and FIG. 9 shows a side view of the assembly after a pedal is folded, wherein a main stand body 31 is disposed vertically with respect to the floor only. If there are various different musical instruments and the space for installing these musical instruments is limited, it is necessary to move the musical instruments outward for installing all of the required musical instruments, the distance of the musical instruments from the musician will be increased, and thus the musician's striking angle and position will be affected when the extended length of the musician's hand and striking rod cannot reach the adjusted distance of the musical instruments. In other words, the musician cannot strike a desired striking position of the musical instrument which definitely will affect the musician's performance. If the main stand body comes with a forward inclined design, problems of this sort can be solved.

In addition, the prior art mainly uses a positioning element 32 to fix and connect its fixed frame 33 and side frame 34, and a pedal 35 is extended outward and spread open, such that when the side frame 34 is placed horizontally outward, a bolt 321 of the positioning element 32 will be situated at the top of a limit position hole 322, and a first limit position portion 323 and a second limit position portion 324 will be latched to both sides of the top of the side frame 34, so that the fixed frame 33 and the side frame 34 are fixed into position.

If it is necessary to fold the pedal 35, the bolt 321 will be loosened first, and then a turning plate 325 of the positioning element 32 is lifted by a finger to move the positioning element 32 upward and allow the bolt 321 to be situated below the limit position hole 322, such that the side frame 34 is no longer latched with the first limit position portion 323. Since an indent 326 is disposed below the first limit position portion 323, both sides of the side frames 34 of the fixed frame 33 are pivotally folded upward. After the side frames 34 are folded and fixed, a bolt 321 is used for locking and fixing the side frames 34 as shown in FIG. 9.

However, the aforementioned folding process of the pedal 35 is complicated and inconvenient, and it is necessary to loosen the bolt 321 to move the positioning element 32 upward and then fold the side frame 34 upward, and finally secure the bolt 321, wherein the bolt 321 is loosened while the positioning element 32 is moving upward. If a user's hand leaves the positioning element 32 by accident, the positioning element 32 will slide down to latch the sidewalls of the side frame 34, and thus it is necessary to move the positioning element 32 upward to fold the pedal 35, which is definitely very inconvenient. If the user has not noticed the situation of a sliding-down positioning element 32 and continues folding the side frame 34 with a large force, the first limit position portion 323 of the positioning element 32 may be deformed or cracked easily. Obviously, the prior art requires improvements.

SUMMARY OF THE INVENTION

It is a primary objective of the present invention to provide a musical instrument stand assembly with a foldable pedal, wherein a design of engaging a first circular serration of two support rods and a second circular serration of two side frames is used for providing a function of adjusting the inclination of the main stand body of the musical instrument, so that a musician can strike the musical instruments at better striking angle and position.

Another objective of the present invention is to engage a first circular serration of the two support rods and a second circular serration of the two side frames for achieving the effect of folding the pedal of the musical instrument more quickly and conveniently.

To achieve the foregoing objectives, the present invention comprises:

a main stand body, having a main rod, the main rod having a pull rod penetrated and disposed at a top end of the main rod and connected to a musical instrument, and a bottom end of the pull rod being connected to a connecting element, and both sides of a wall proximate to the bottom of the main rod separately having a support rod extended from an internal side downward, and the connecting element being disposed between the two support rods, and an external sidewall of the two support rods having a recession, and the recessions of the two support rods being in opposite directions with each other, and the middle of each recession having a penetrating hole, and the bottom surface of the recession forming a radiating first circular serration around the penetrating hole;

a pedal module, including two side frames, two slide bars, a pedal and a lump, wherein:

each side frame includes a first section and a second section, and the first section and the second section are perpendicular to each other, and the first section of each side frame includes a protrusion, and the middle of the protrusion includes a through hole, and external surface of the protrusion forms a radiating second circular serration around the through hole, and the protrusion of each side frame is installed corresponding to the recession of the support rod, and the second circular serration of the protrusion is engaged with the first circular serration of the recession, and a first locking element is passed through a through hole of each side frame and a penetrating hole of the support rod, such that the first and second circular serrations are secured with each other after they are engaged and adjusted;

the second section of each side frame includes a guide slot, and a rail disposed separately on lateral sides of the second section of the two side frames, and the guide slot is hollow in shape and corresponsive to the rail;

an end of each slide bar has a hole, for sliding each slide bar into a rail on each side frame, and a second locking element is passed through the guide slot and the hole, such that each slide bar adjusts the length extended outward with respect to the second section of each side frame; and the pedal is disposed between the two side frames and the two slide bars, and a front end of the pedal is elevated and connected to the bottom of the connecting element, and a rear end of the pedal is pivotally coupled to the lump, and other ends of the two slide bars are fixed to both sides of the lump respectively.

DETAILED DESCRIPTION OF THE PREFERRED EMBODIMENTS

Figure 1:
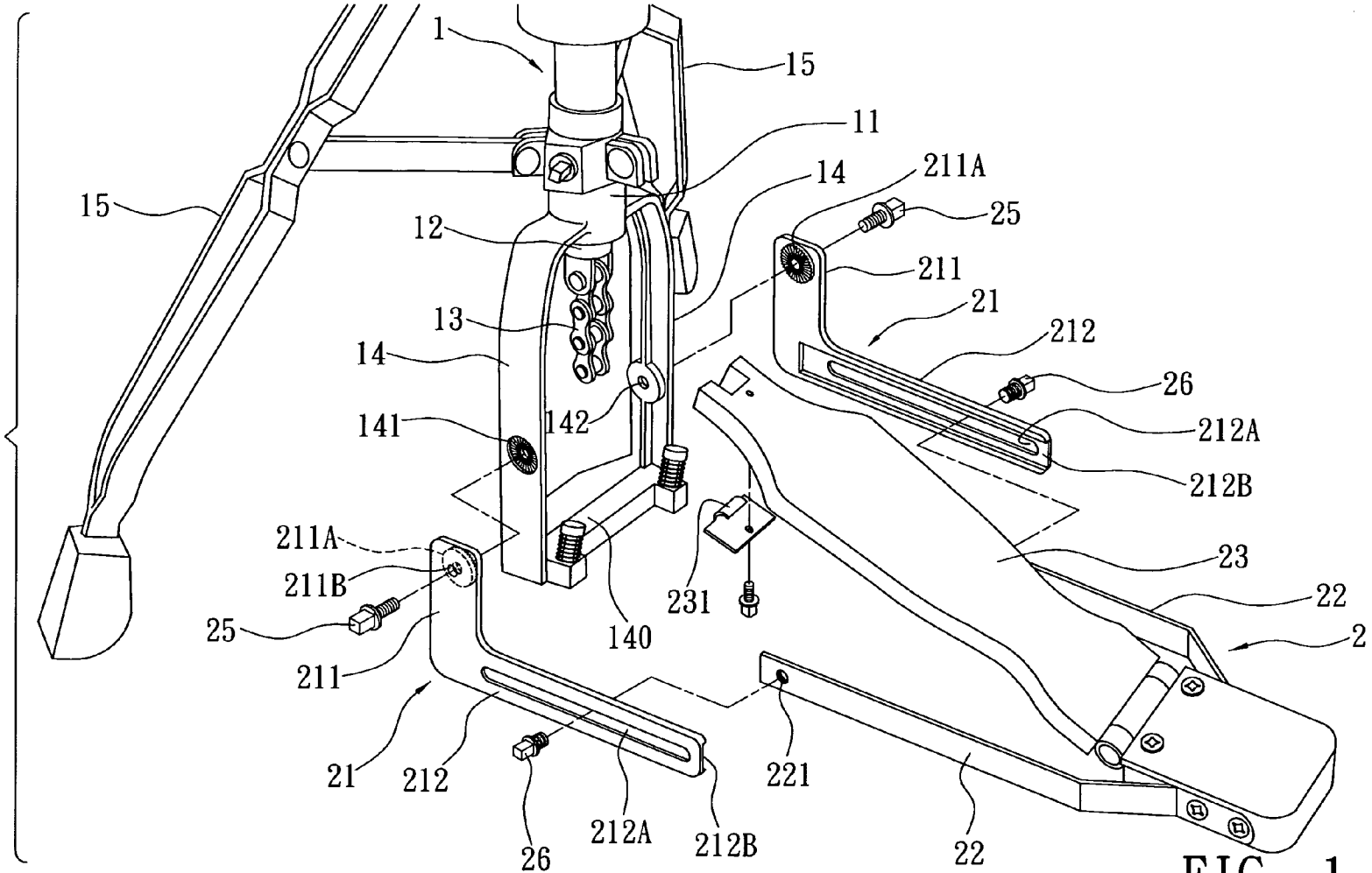
FIG. 1 is an exploded view of a musical instrument stand assembly with a foldable pedal in accordance with the present invention.

Referring to FIGS. 1 to 6 for preferred embodiments of the present invention, the embodiments are used for illustration of the invention only, but not intended to limit the scope of the present invention.

A musical instrument stand assembly with a foldable pedal in accordance with a preferred embodiment of the invention comprises:

a main stand body 1, for installing a musical instrument, and the musical instrument is a cymbal for example, and the main stand body 1 includes an erected main rod 11, and the main rod 11 has a pull rod 12 penetrated through the top of the main rod 11 and connected with the musical instrument, and the bottom of the pull rod 12 is connected with a connecting element, and the connecting element is a chain 13 in this embodiment, and the main rod 11 has a support rod 14 extended outwardly from both sides of a wall proximate to the bottom, and the two support rods 14 on both sides of the main rod 1 forms a door shape, and a base 140 is formed at the bottom between the two support rods 14, and the connecting element (which is the chain 13) is situated between the two support rods 14, and each external wall of the two support rods 14 includes a circular recession 141, and the recessions 141 of the two support rods 14 are in opposite directions, and the middle of each recession 141 has a penetrating hole 142, and a radiating first circular serration 143 is formed around the penetrating hole 142 at the bottom of the recession 141. Further, the main stand body 1 includes two support stands 15, and the bottom of each support stand 15 abuts the floor to provide a more secured disposition of the main stand body 1.

A pedal module 2 comprises two side frames 21, two slide bars 22, a pedal 23 and a lump 24, wherein:

each side frame 21, having a first section 211 and a second section 212, and the first section 211 and the second section 212 are perpendicular with each other to form an L-shape, and the first section 211 of each side frame 21 includes a circular protrusion 211A, and the middle of the protrusion 211A has a through hole 211B, and an external side of the protrusion 211A forms a radiating second circular serration 211C around the through hole 211B. Further, the protrusion 211A of each side frame 21 is installed correspondingly with the recession 141 of the support rod 14, and the second circular serration 211C of the protrusion 211A is engaged with the first circular serration 143 of the recession 141, and a first locking element 25 is passed through the through hole 211B of each side frame 21 and the penetrating hole 142 of the support rod 14 to secure the first circular serration 143 and the second circular serration 211C after they are engaged and adjusted. In this embodiment, the teeth of the first circular serration 143 and the second circular serration 211C are in a continuous wedge-shape.

The second section 212 of each side frame 21 includes a long guide slot 212A, and a rail 212B disposed separately on opposite sides of the second section 212 of the two side frames 21, and the guide slot 212A is in a hollow form disposed with respect to the rail 212B.

An end of each slide bar 22 includes a hole 221, and each slide bar 22 is slid into the rail 212B of each side frame 21 from this end, and a second locking element 26 is passed through the guide slot 212A and the hole 221 for the locking such that each slide bar 22 adjusts its length of extension with respect to the second section 212 of each side frame 21.

The pedal 23 is situated between the two side frames 21 and the two slide bars 22, and the front end of the pedal 23 is elevated and connected to the bottom of the connecting element (which is the chain 13), and the rear end of the pedal 23 is pivotally coupled to the front side of the lump 24, and other ends of the two slide bars 22 are fixed on both left and right sides of the lump 24 respectively. In this embodiment, the front end of the pedal 23 has a hook portion 231 latched to a distal end of the chain 13.

In an application, a musical instrument player's foot steps on the pedal 23, and the top of the lump 24 is provided for the musician's foot to press on.

Figure 2:
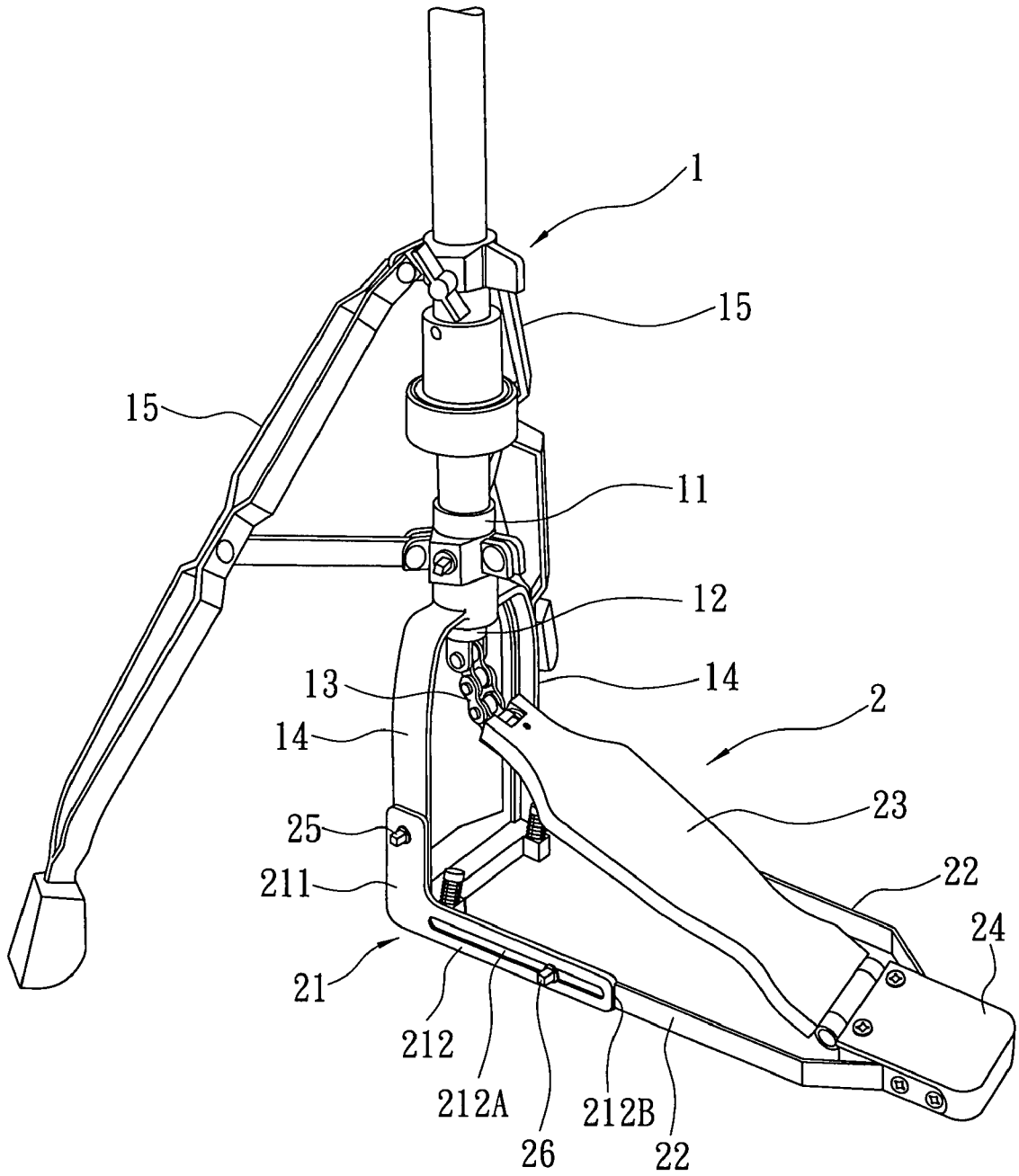
FIG. 2 is a perspective view of the assembly as depicted in FIG. 1.
Figure 3:
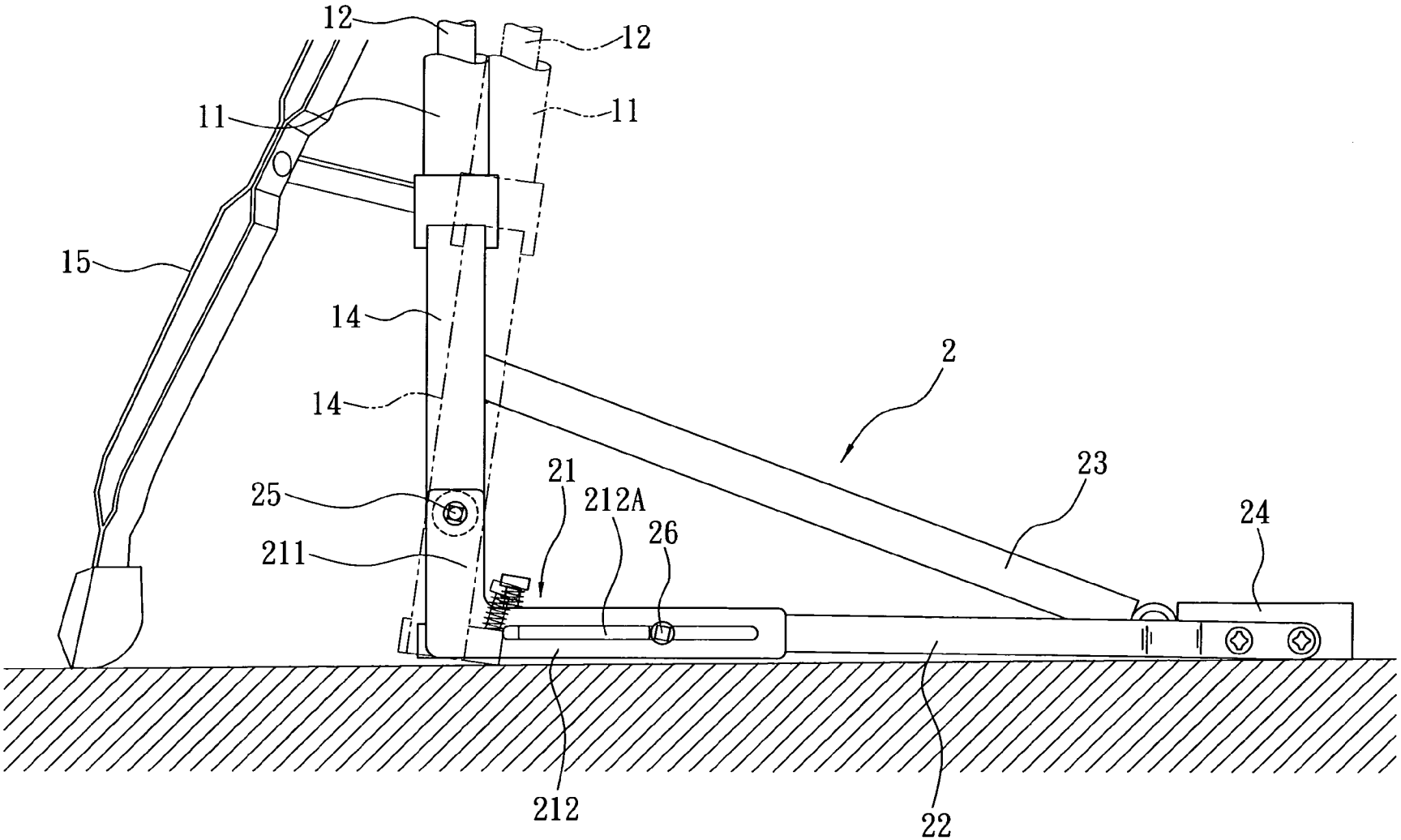
FIG. 3 is a side view of FIG. 2, wherein a main stand body is tilted with respect to its vertical position.
Figure 4:
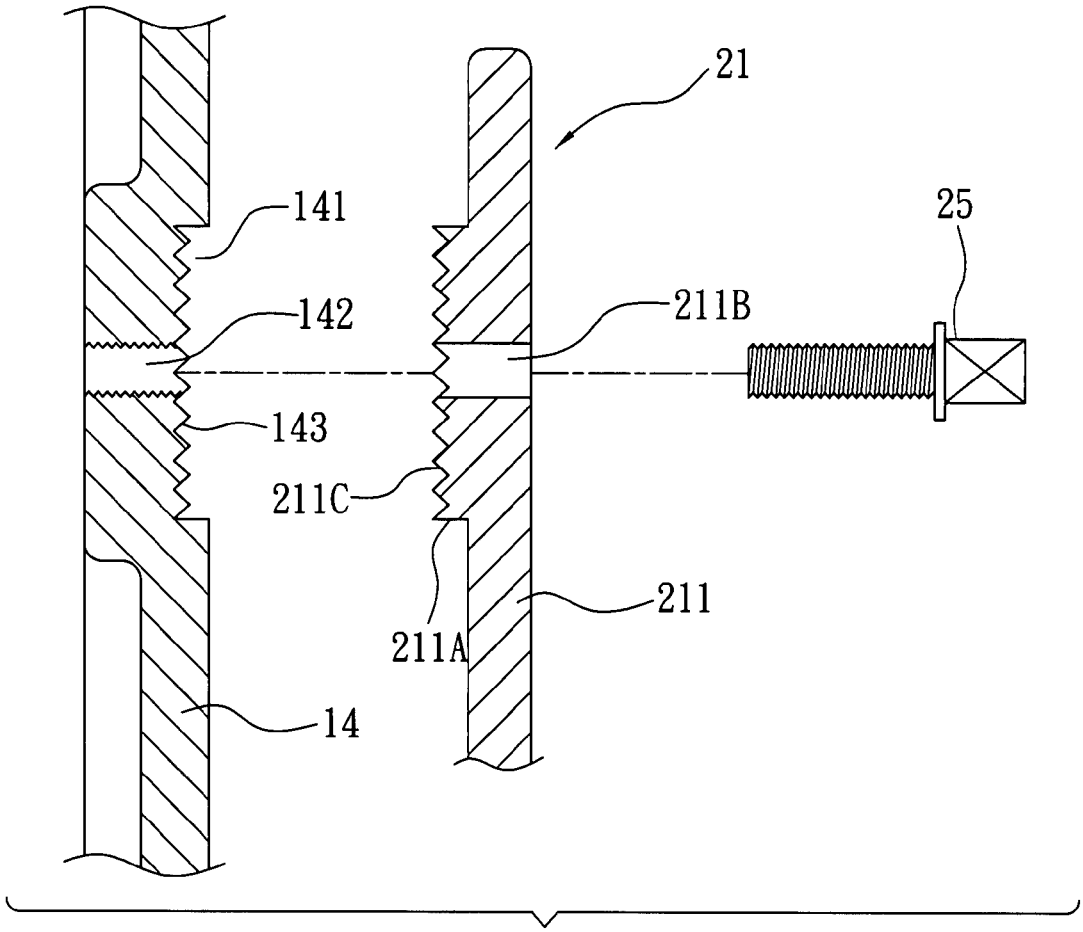
FIG. 4 is a section view of a support rod and a side frame as depicted in FIG. 1 before they are engaged by a first circular serration and a second circular serration.
Figure 5:
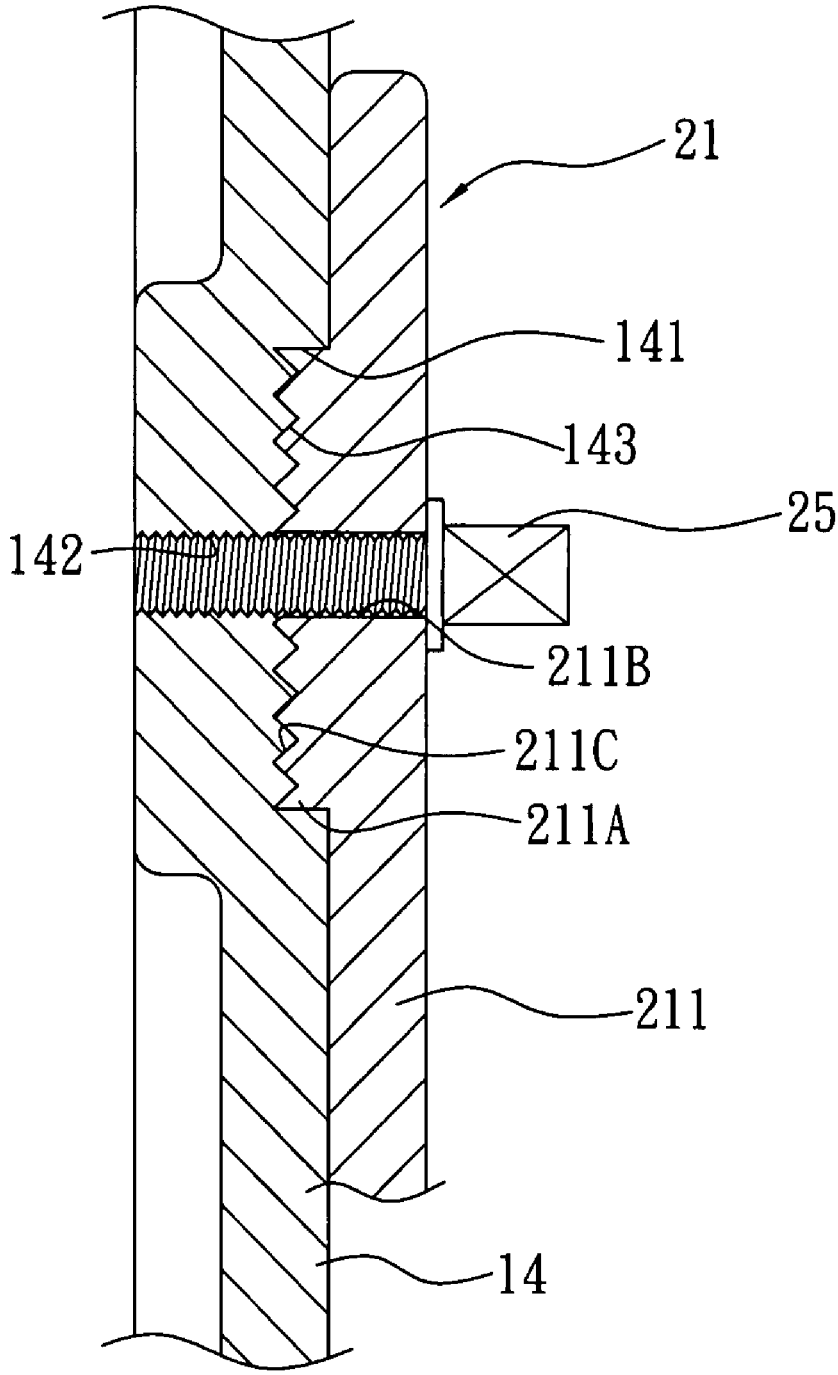
FIG. 5 is a section view of a first circular serration and a second circular serration as depicted in FIG. 4 while they are being engaged.

Referring to FIGS. 2, 3 and 5, the distance from a striker's hand or a striking rod to the position of a musical instrument (such as a cymbal) can be adjusted by loosening each first locking element 25, and the design of engaging the first circular serration 143 of the two support rods 14 and the second circular serration 211C of the two side frames 21 appropriately tilts the main rod 11 of the main stand body 1 forward according to the required angle and distance, and each first locking element 25 is secured after the adjustment is made, so as to provide an appropriate distance between the striker's hand or striking rod and the musical instrument (such as the cymbal).

Figure 6:
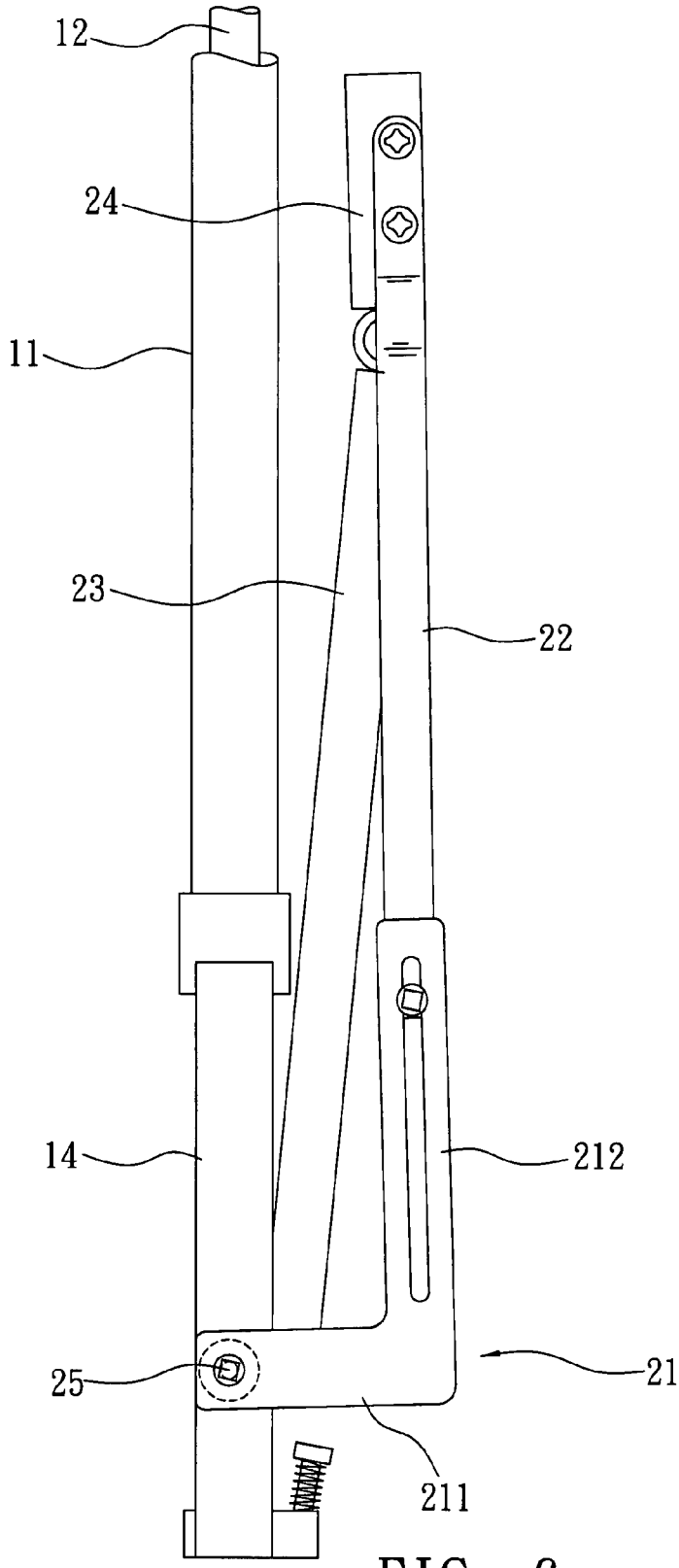
FIG. 6 PRIOR ART
FIG. 6 is a side view of a pedal being folded.
Figure 7:
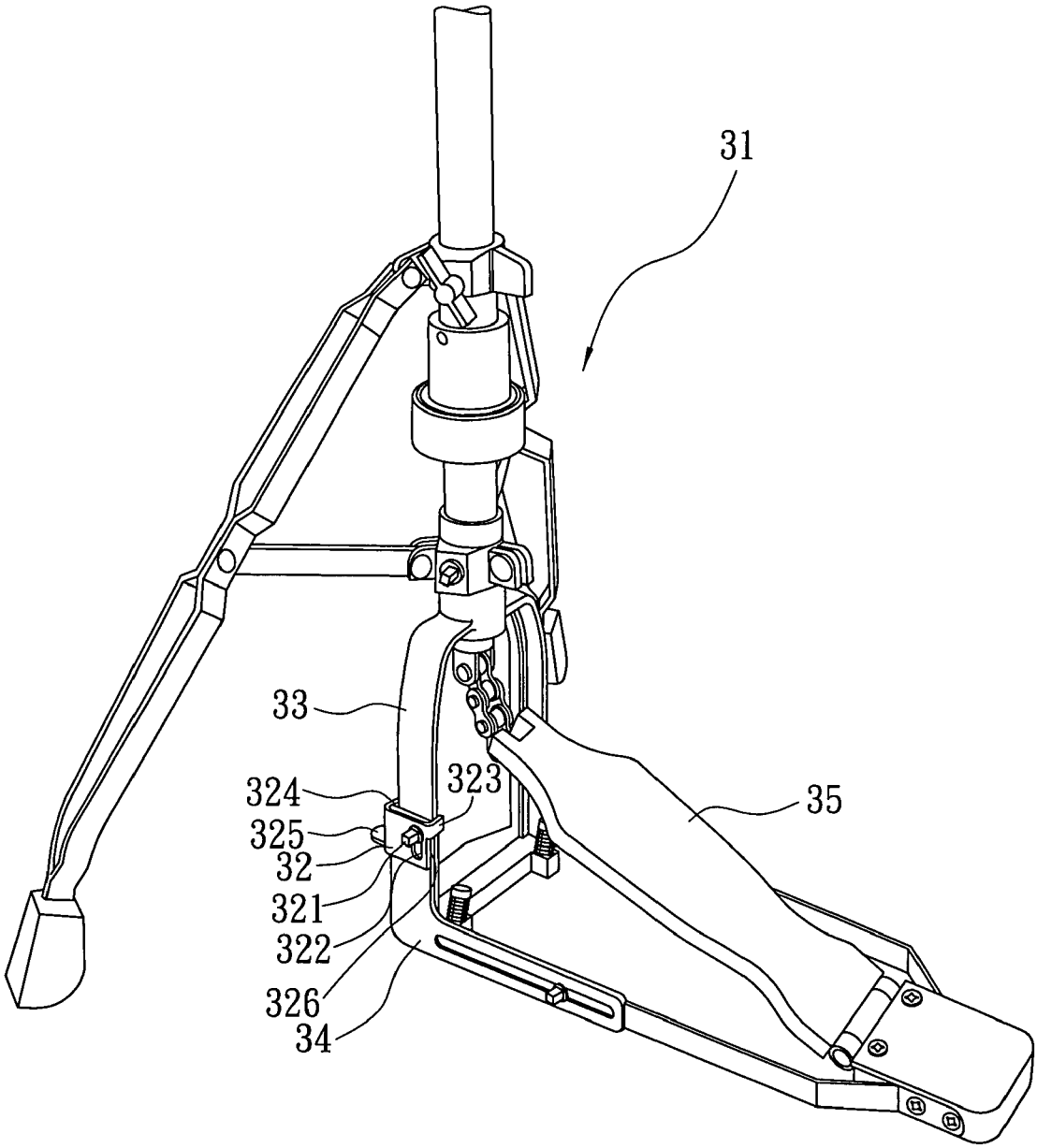
FIG. 7 PRIOR ART
FIG. 7 is a perspective view of a prior art musical instrument stand assembly having a foldable pedal, wherein a fixed frame can be installed perpendicularly to the floor compared with a side frame.
Figure 8:
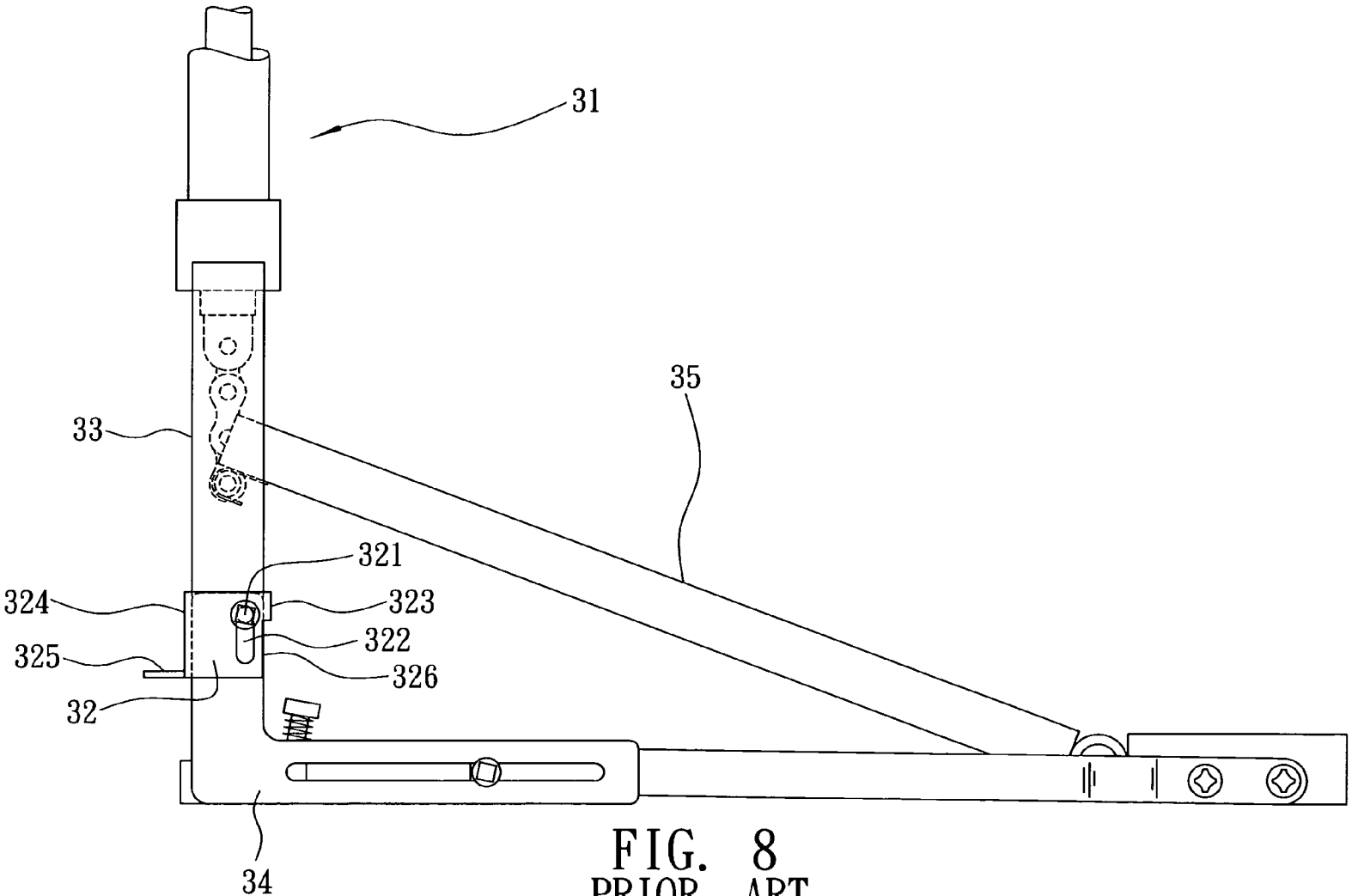
FIG. 8 PRIOR ART
FIG. 8 is a side view of FIG. 7.
Figure 9:
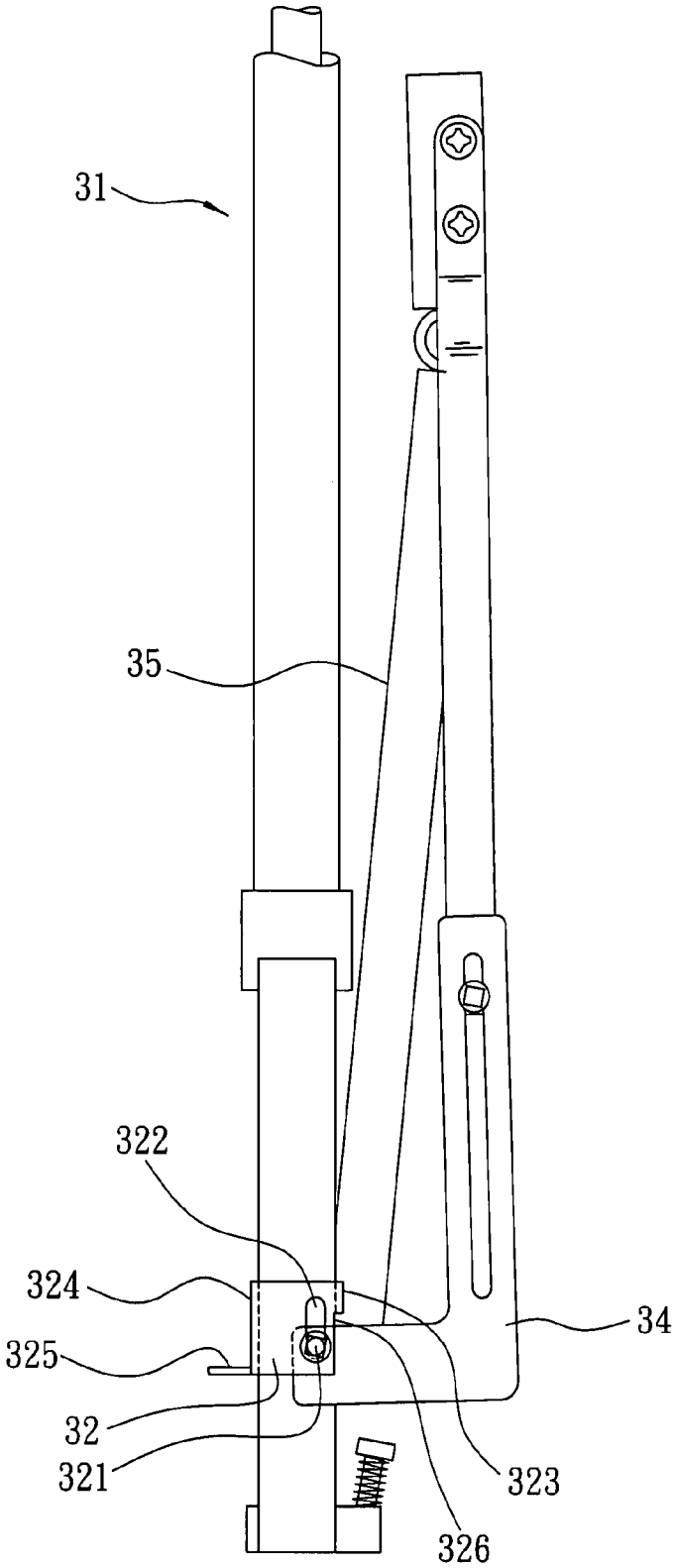
FIG. 9 PRIOR ART
FIG. 9 is a side view of folding a pedal as depicted in FIG. 7.

Referring to FIG. 6, if it is necessary to fold the pedal 23, the latch between the hook portion 231 at the front end of the pedal 23 and the distal end of the chain 13 is released to separate the hook portion 31 from the chain 13, and each first locking element 25 is loosened, and the second section 212 of the two side frames 21 is pivotally turned and folded towards each support rod 14, so that the components including the two slide bars 22, the pedal 23 and the lump 24 are folded upward, and then each first locking element 25 is secured to complete the task of folding the pedal of a musical instrument.

In summation of the description above, the musical instrument stand assembly of the invention comes with a design of rotably engaging the first circular serration of the recession of the two support rods with the second circular serration of the protrusion of the two side frames to provide the main stand body of the musical instrument a function of adjusting its inclination with respect to the vertical position. In the meantime, the design of rotably engaging the first and second circular serrations provides a more convenient way of folding the pedal than the prior arts, since the prior arts usually have to go through the process of loosening the bolt, folding the pedal and securing the bolt again as well as the step of moving the positioning element upward. However, the present invention simply requires going through the loosening-folding-securing process only, and thus the invention provides a better and more convenient way of folding the pedal.

What is claimed is:

1. A musical instrument stand assembly with a foldable pedal, comprising:

a main stand body, having a main rod, the main rod having a pull rod penetrated and disposed at a top end of the main rod and connected to a musical instrument, and a bottom end of the pull rod being connected to a connecting element, and both sides of a wall proximate to the bottom of the main rod separately having a support rod extended from an internal side downward, and the connecting element being disposed between the two support rods, and an external sidewall of the two support rods having a recession, and the recessions of the two support rods being in opposite directions with each other, and the middle of each recession having a penetrating hole, and the bottom surface of the recession forming a radiating first circular serration around the penetrating hole;

a pedal module, including two side frames, two slide bars, a pedal and a lump, wherein:

each side frame includes a first section and a second section, and the first section and the second section are perpendicular to each other, and the first section of each side frame includes a protrusion, and the middle of the protrusion includes a through hole, and external surface of the protrusion forms a radiating second circular serration around the through hole, and the protrusion of each side frame is installed corresponding to the recession of the support rod, and the second circular serration of the protrusion is engaged with the first circular serration of the recession, and a first locking element is passed through a through hole of each side frame and a penetrating hole of the support rod, such that the first and second circular serrations are secured with each other after they are engaged and adjusted;

the second section of each side frame includes a guide slot, and a rail disposed separately on lateral sides of the second section of the two side frames, and the guide slot is hollow in shape and corresponsive to the rail;

an end of each slide bar has a hole, for sliding each slide bar into a rail on each side frame, and a second locking element is passed through the guide slot and the hole, such that each slide bar adjusts the length extended outward with respect to the second section of each side frame; and the pedal is disposed between the two side frames and the two slide bars, and a front end of the pedal is elevated and connected to the bottom of the connecting element, and a rear end of the pedal is pivotally coupled to the lump, and other ends of the two slide bars are fixed to both sides of the lump respectively.

2. The musical instrument stand assembly with a foldable pedal as recited in claim 1, wherein the connecting element is a chain.

3. The musical instrument stand assembly with a foldable pedal as recited in claim 2, wherein the pedal includes a hook portion disposed on the bottom of a front edge of the pedal and latched with an end of the chain.

4. The musical instrument stand assembly with a foldable pedal as recited in claim 1, wherein the recession on the external sidewall of each support rod is substantially circular in shape, and the protrusion of the first section of each side frame is substantially circular in shape.

5. The musical instrument stand assembly with a foldable pedal as recited in claim 1, wherein the first circular serration and the second circular serration have teeth substantially in a continuous wedge-shape.

6. The musical instrument stand assembly with a foldable pedal as recited in claim 1, wherein the guide slot of the second section of each side frame is substantially rectangular in shape.

7. The musical instrument stand assembly with a foldable pedal as recited in claim 1, wherein the main stand body further installs two support stands, and the bottom of each support stand abuts the floor.

* * * * *